US008173976B2

(12) United States Patent
Egley et al.

(10) Patent No.: US 8,173,976 B2
(45) Date of Patent: May 8, 2012

(54) LINEAR ION PROCESSING APPARATUS WITH IMPROVED MECHANICAL ISOLATION AND ASSEMBLY

(75) Inventors: Bert David Egley, Walnut Creek, CA (US); August Specht, Walnut Creek, CA (US); Kenneth Newton, Concord, CA (US); Dave Deford, Pleasanton, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 473 days.

(21) Appl. No.: 12/509,332

(22) Filed: Jul. 24, 2009

(65) Prior Publication Data

US 2011/0016700 A1 Jan. 27, 2011

(51) Int. Cl.
*G21K 1/08* (2006.01)

(52) U.S. Cl. ..... 250/492.1; 250/281; 250/282; 250/492.3; 250/396 R

(58) Field of Classification Search ..... 250/281, 250/282, 492.1, 492.2, 492.3, 423 R, 396 R, 250/396 ML
See application file for complete search history.

(56) References Cited

U.S. PATENT DOCUMENTS

| | | | |
|---|---|---|---|
| 3,940,616 | A | 2/1976 | Ball et al. |
| 4,032,782 | A | 6/1977 | Smith et al. |
| 4,870,283 | A | 9/1989 | Taya |
| 2006/0102835 | A1 | 5/2006 | Laser |
| 2007/0114391 | A1 | 5/2007 | Mordehai et al. |
| 2007/0176095 | A1 | 8/2007 | Tong et al. |
| 2007/0187614 | A1 | 8/2007 | Schneider et al. |

FOREIGN PATENT DOCUMENTS

| | | | |
|---|---|---|---|
| JP | 59087743 | A1 | 5/1984 |
| WO | 2007149706 | A2 | 12/2007 |

OTHER PUBLICATIONS

European Patent Office, PCT International Search Report, Oct. 28, 2010.

*Primary Examiner* — Michael Maskell

(57) ABSTRACT

An ion processing apparatus includes a plurality of electrodes, first and second insulators, a housing, and a plurality of compliant first supports and second supports. Each electrode has a length along a central axis, and includes a first end region and an axially opposing second end region. The first and second insulators are coaxially disposed about the first and second end regions, respectively. The housing is coaxially disposed about the electrodes, the first insulator and the second insulator. The first supports extend between, and into contact with, the first insulator and the housing. The second supports extend between, and into contact with, the second insulator and the housing. The supports isolate the electrodes from external forces.

20 Claims, 11 Drawing Sheets

LINEAR ION PROCESSING APPARATUS WITH IMPROVED MECHANICAL ISOLATION AND ASSEMBLY

FIELD OF THE INVENTION

The present invention relates generally to ion processing devices and associated electrode structures of two-dimensional (linear) geometry. The invention also relates to methods for fabricating the electrode structures and assembling the ion processing devices. The ion processing devices may be employed, for example, in conjunction with mass spectrometry-related operations.

BACKGROUND OF THE INVENTION

A two-dimensional (or linear) ion-processing device such as an ion trap is formed by a set of electrodes coaxially arranged about a central (z) axis of the device and having predominant lengths in the direction of the central axis. Each electrode is positioned in the (x-y) plane orthogonal to the central axis at a radial distance from the central axis. The resulting electrode arrangement defines an axially elongated interior space of the device between opposing inside surfaces of the electrodes. In operation, ions may be introduced, trapped, stored, isolated, and subjected to various reactions in the interior space, and may be ejected from the interior space for detection. Such manipulations require precise control over the motions of the ions present in the interior space. The radial excursions of ions along the x-y plane may be controlled by applying a two-dimensional RF trapping field between opposing pairs of electrodes. The axial excursions of ions, or the motion of ions along the central axis, may be controlled by applying an axial DC trapping field between the axial ends of the electrodes. Additionally, auxiliary or supplemental RF fields may be applied between an opposing pair of electrodes to increase the amplitudes of oscillation of ions of selected mass-to-charge ratios along the axis of the electrode pair and thereby increase the kinetic energies of the ions for various purposes, including ion ejection and collision-induced dissociation (CID).

Ions present in the interior space of the electrode set are responsive to, and their motions influenced by, electric fields active within the interior space. These fields include fields applied intentionally by electrical means as in the case of the above-noted DC and RF fields, and fields inherently (mechanically) generated due to the physical/geometric features of the electrode set. The applied fields are not only governed by their applied operating parameters (amplitude, frequency, phase, and the like) but also by the fabrication and assembly, and resulting geometry and stability, of the physical components of the electrode structure. The inherently generated fields are often not intentional and often not desirable for optimal operation of the ion processing device. The inherently generated fields are also governed by the fabrication, assembly, geometry and stability of the electrodes. In particular, both applied fields and inherently generated fields are governed by the configuration (profile, geometry, features, and the like) of the inside surfaces of the electrodes exposed to the interior space. In advanced ion processing devices, the inside surfaces of the electrodes are typically hyperbolic with apices facing inwardly toward the central axis. Ideally, these inside surfaces are precisely machined with exceedingly close tolerances to accurately provide the intended profile (e.g., a hyperbolic sheet or other desired curved surface). Moreover, even when the inside surfaces are precisely machined, the positions of the electrodes relative to one another still need to be precisely oriented in the radial plane, and their orientations need to be maintained during operation, so that a given inside surface is not rotated, skewed, or otherwise out of orientation with the other inside surfaces. The positions of the electrodes also need to be accurately controlled and maintained relative to the z-axis so that the electrodes are precisely parallel to one another. For an electrode set of typical dimensions, the mechanical tolerance in the parallelism between an opposing pair of electrodes should be no greater than ±20 μm to obtain acceptable mass unit resolution.

Any differences in an electrical field relative to axial position along the central axis of the electrode set can adversely affect the desired response of the ions and consequently the performance of the electrode set as an ion-processing device. For instance, when the electrode set is employed as an ion-trap mass analyzer, non-uniformity in the field along the central axis can cause ions of the same mass-to-charge ratio to be ejected at different instances of time, resulting in a loss in mass resolution. Inferior fabrication, assembly, geometry and stability of the electrodes may lead to imperfect curvatures, improperly oriented electrode surfaces, and non-parallel electrodes. These problems may in turn cause non-uniformity in applied fields and unwanted inherently-generated fields. Moreover, the electrode set and its supporting components may be subjected to external forces from a variety of sources such as mounting stresses and strains, external thermal strains, handling or shipping loads, or creep of external components even after many years at the site of operation. Such external forces may distort the electrodes, alter the shapes of their surfaces, and cause the electrodes to lose their parallelism.

In view of the foregoing, there is a need for isolating electrode sets and associated components of ion processing devices from external forces. There is also a need to provide improved methods for fabricating and assembling such electrode sets and ion processing devices.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an ion processing apparatus includes a plurality of main electrodes, first and second insulators, a housing, and a plurality of compliant first supports and second supports. The main electrodes are coaxially disposed about a central axis. Each main electrode has an axial length extending generally in the direction of the central axis, and includes a first end region and an axially opposing second end region. The first insulator is coaxially disposed about the first end regions. The second insulator is coaxially disposed about the second end regions. The housing is coaxially disposed about the plurality of main electrodes, the first insulator and the second insulator. The first supports extend between, and into contact with, the first insulator and the housing. The second supports extend between, and into contact with, the second insulator and the housing.

According to another implementation, the ion processing apparatus further includes a plurality of first pins and second pins. The first pins contact respective first supports and main electrodes, wherein the first pins fix respective positions of the first supports and the first insulator relative to the main electrodes. The second pins contact respective second supports and main electrodes, wherein the second pins fix respective positions of the second supports and the second insulator relative to the main electrodes According to another implementation, a method is provided for constructing an ion processing apparatus. An electrode blank is inserted between a first insulator and a second insulator. The electrode blank has an axial length along a central axis and includes a first end region and an axially opposing second end region. The first insulator is coaxially disposed about the first end region and the second insulator is coaxially disposed about the second end region. The electrode blank, the first insulator and the second insulator are inserted into a housing. A plurality of compliant first supports is placed between, and into contact with, the first insulator and the housing. A plurality of compliant second supports is placed between, and into contact with, the second insulator and the housing. The electrode blank is formed into a plurality of electrodes, wherein each electrode is supported by a first support at the first insulator and by a second support at the second insulator.

According to another implementation, the method further includes fixing respective positions of the first support and the first insulator relative to the electrode blank by placing a plurality of first pins into contact with respective first supports and the electrode blank, and fixing respective positions of the second support and the second insulator relative to the electrode blank by placing a plurality of second pins into contact with respective second supports and the electrode blank.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DETAILED DESCRIPTION OF THE INVENTION

Figure 1:
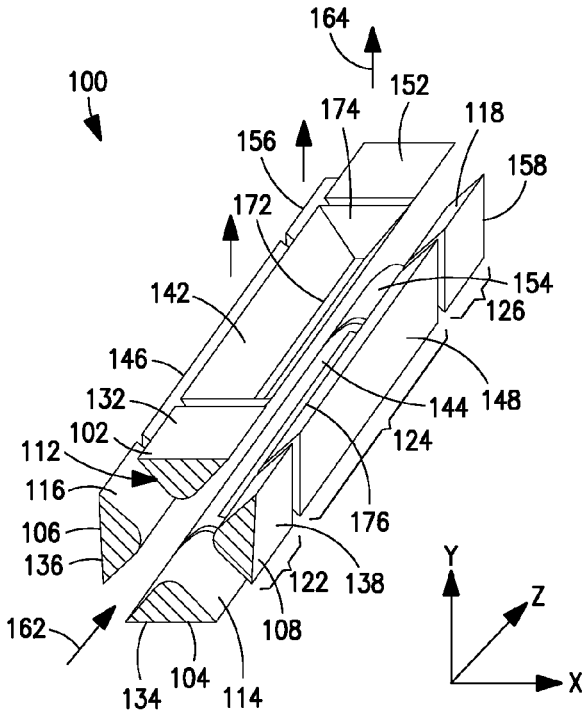
FIG. 1 is a perspective view of an example of an electrode set of linear (two-dimensional) geometry that may be utilized to manipulate or process ions.
Figure 2:
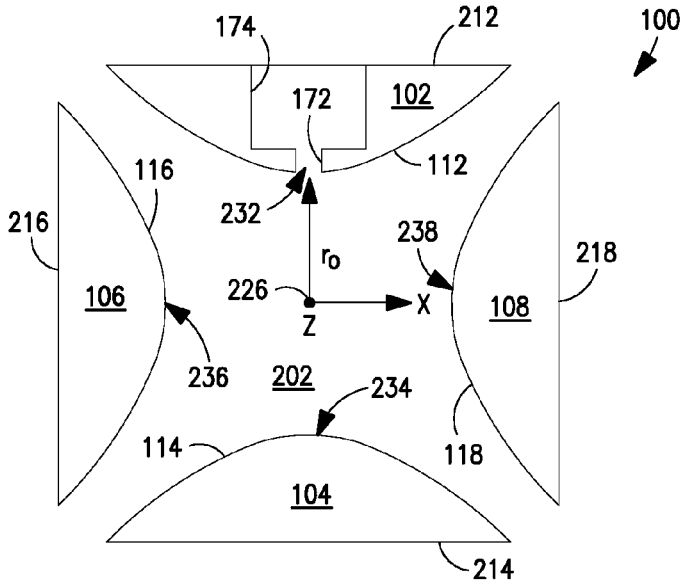
FIG. 2 is a cross-sectional view of the electrode structure illustrated in FIG. 1, taken in a radial (x-y) plane orthogonal to a central axis of the electrode set.
Figure 3:
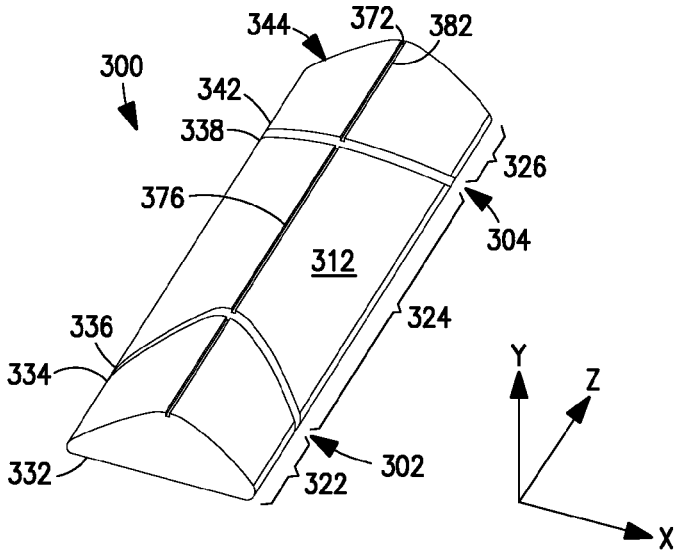
FIG. 3 is a perspective view of an example of an electrode that may be provided in the electrode set illustrated in FIGS. 1 and 2.
Figure 4:
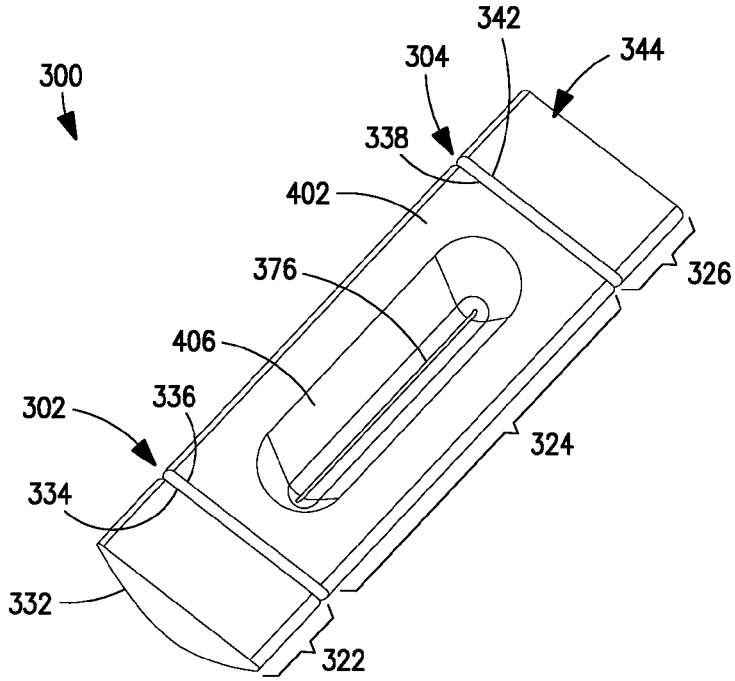
FIG. 4 is a perspective view of the electrode illustrated in FIG. 3, from an opposite side.

FIGS. 1 and 2 illustrate an example of an electrode set 100 of linear (two-dimensional) geometry that may be utilized to manipulate or process ions. FIGS. 1 and 2 also include a Cartesian (x, y, z) coordinate frame for reference purposes. For descriptive purposes, directions or orientations along the z-axis will be referred to as being axial, and directions or orientations along the orthogonal x-axis and y-axis will be referred to as being radial or transverse. Specifically, FIG. 1 is a perspective view of the electrode set 100. FIG. 2 is a cross-sectional view of the electrode set 100 taken in the x-y plane at any axial position along the z-axis. FIGS. 3 and 4 illustrate additional examples of electrodes that may be provided with the electrode set 100.

Referring to FIG. 1, the electrode structure 100 includes a plurality of electrodes 102, 104, 106 and 108, each having a dominant or elongated dimension (e.g., length) that extends in directions generally parallel with the z-axis. In many implementations, the electrodes 102, 104, 106 and 108 are exactly parallel with the z-axis or as parallel as practicably possible. This parallelism can enable better predictability of and control over ion behavior during operations in which RF fields are applied to the electrode structure 100. With parallel electrodes 102, 104, 106 and 108, assuming no field defects, the strength (amplitude) of an RF field encountered by an ion does not change with the axial position of the ion in the electrode structure 100, and ions can be ejected from the electrode structure 100 on a purely mass-dependent basis without their axial positions contributing to broadening of the mass spectral peaks or concomitant degradation of mass resolution in the output data. Moreover, the magnitude of a DC potential applied end-to-end to the electrode structure 100 does not change with axial position.

The example illustrated in FIG. 1 provides four electrodes 102, 104, 106 and 108. The first electrode 102 and the second electrode 104 are generally arranged as an opposing pair along the y-axis, and the third electrode 106 and the fourth electrode 108 are generally arranged as an opposing pair along the x-axis. This example is typical of quadrupolar electrode arrangements for linear ion traps as well as other quadrupolar ion processing devices. In other implementations, the number of electrodes 102, 104, 106 and 108 may be other than four. Each electrode 102, 104, 106 and 108 may be electrically interconnected with one or more of the other electrodes 102, 104, 106 and 108 as needed for generating desired electrical fields within the electrode structure 100. Typically, radially opposing electrode pairs 102, 104 and 106, 108 are interconnected. As also shown in FIG. 1, the electrodes 102, 104, 106 and 108 include respective inside surfaces 112, 114, 116 and 118 generally facing toward the center of the electrode structure 100.

FIG. 2 illustrates a cross-section of the electrode structure 100 in the x-y plane. The electrode structure 100 has an interior space or chamber 202 generally circumscribed by the electrodes 102, 104, 106 and 108. The interior space 202 is elongated along the z-axis as a result of the elongation of the electrodes 102, 104, 106 and 108 along the same axis. The inside surfaces 112, 114, 116 and 118 of the electrodes 102, 104, 106 and 108 generally face toward the interior space 202 and thus in practice are exposed to ions residing in the interior space 202. The electrodes 102, 104, 106 and 108 also include respective outside surfaces 212, 214, 216 and 218 generally facing away from the interior space 202. As also shown in FIG. 2, the electrodes 102, 104, 106 and 108 are coaxially positioned about a main or central longitudinal axis 226 (z-axis) running through the interior space 202, which typically coincides with the geometric center of the electrode structure 100. Each electrode 102, 104, 106 and 108 is positioned at some radial distance $r_0$ in the x-y plane from the central axis 226. In some implementations, the respective radial positions of the electrodes 102, 104, 106 and 108 relative to the central axis 226 are equal. In other implementations, the radial positions of one or more of the electrodes 102, 104, 106 and 108 may intentionally differ from the radial positions of the other electrodes 102, 104, 106 and 108 for such purposes as introducing certain types of electrical field effects or compensating for undesired field effects. For example, the distance between one radially opposing electrode pair may be stretched relative to another radially opposing electrode pair.

The inside surfaces 112, 114, 116 and 118 of the respective electrodes 102, 104, 106 and 108 may be curved in the x-y plane. In the example specifically illustrated in FIG. 2, the inside surfaces 112, 114, 116 and 118 are generally hyperbolic to facilitate the utilization of precise quadrupolar ion trapping fields. The hyperbolic profile may fit a perfect hyperbola or may deviate somewhat from a perfect hyperbola to modify field effects in a desired manner. In either case, each inside surface 112, 114, 116 and 118 is curvilinear and has a single point of inflection and thus a respective apex or vertex 232, 234, 236 and 238 that extends as a line along the z-axis. Each apex 232, 234, 236 and 238 is typically the point on the corresponding inside surface 112, 114, 116 and 118 that is closest to the central axis 226 of the interior space 202. In the present example, taking the central axis 226 as the z-axis, the respective apices 232 and 234 of the first electrode 102 and the second electrode 104 generally coincide with the y-axis, and the respective apices 236 and 238 of the third electrode 106 and the fourth electrode 108 generally coincide with the x-axis. In such implementations, the radial distance $r_0$ is defined between the central axis 226 and the apex 232, 234, 236 and 238 of the corresponding electrode 102, 104, 106 and 108.

In other implementations, the inside surfaces 112, 114, 116 and 118 may have a non-ideal hyperbolic shape such as a circle or other type of curve. In still other implementations, the inside surfaces 112, 114, 116 and 118 may be planar or polygonal.

As illustrated by way of example in FIG. 1, in some implementations the electrode set 100 is axially divided into a plurality (e.g., three) of sections or "segments" 122, 124 and 126 relative to the z-axis. Adjacent segments 122, 124 and 124, 126 are physically separated by respective axial gaps. The segmented electrodes 102, 104, 106 and 108 of the electrode set 100 may be considered as comprising respective first end electrodes 132, 134, 136 and 138, central (or main) electrodes 142, 144, 146 and 148, and second end electrodes 152, 154, 156 and 158. The first end electrodes 132, 134, 136 and 138 define the first end segment 122, the central electrodes 142, 144, 146 and 148 define the central or inner segment 124, and the second end electrodes 152, 154, 156 and 158 define the second end segment 126. The electrode set 100 according to the present quadrupolar, segmented example may thus be considered as including twelve axial electrodes 132, 134, 136, 138, 142, 144, 146, 148, 152, 154, 156, and 158. In other implementations, the electrode set 100 may include more than three axial segments 122, 124 and 126 and/or a higher-order arrangement of parallel electrodes (e.g., hexapolar, octopolar, etc.).

In other implementations, the electrodes 102, 104, 106 and 108 are unitary or single-section structures, with no axial gaps and no physically distinct regions 122, 124 and 126. However, axial segmentation provides advantages as discussed in more detail in U.S. Pat. No. 7,501,623, assigned to the assignee of the present disclosure.

As used herein, the term "main electrodes" refers to non-segmented electrodes 102, 104, 106 and 108 of a single-section electrode set. In segmented implementations, the term "main electrodes" may also be used to refer to the central electrodes 142, 144, 146 and 148.

In some implementations, ions may be ejected from the interior space 202 along a direction orthogonal to the central axis 226 (FIG. 2), i.e., in a radial direction in the x-y plane, such as by dipolar resonant excitation or other technique. For example, as shown in FIG. 1, ions may be ejected along the y-axis as indicated by the arrows 164. To facilitate radial ejection, one or more apertures (or slots) may be formed in one or more of the electrodes 102, 104, 106 or 108. In the specific example illustrated in FIGS. 1 and 2, an aperture 172 is formed in one of the y-electrodes 102. The aperture 172 may be elongated along the z-axis to account for the elongated ion-occupied volume produced in the elongated interior space 202 of the electrode structure 100. In practice, a suitable ion detector (not shown) may be placed in alignment with the aperture 172 to measure the flux of ejected ions. To maximize the number of ejected ions that pass completely through the aperture 172 without impinging on the peripheral walls defining the aperture 172 and thus reach the ion detector, the aperture 172 may be centered along the apex 232 (FIG. 2) of the electrode 102. A recess 174 may be formed in the electrode 102 that extends from the outside surface 212 (FIG. 2) to the aperture 172 and surrounds the aperture 172 to minimize the radial channel or depth of the aperture 172 through which the ejected ions must travel. Such a recess 174, if provided, may also facilitate forming the aperture 172 as described below.

To maintain a desired degree of symmetry in the electrical fields generated in the interior space 202, another aperture 176 may be formed in the electrode 104 opposite to the electrode 102 even if another corresponding ion detector is not provided. Likewise, apertures may be formed in all of the electrodes 102, 104, 106 and 108. Moreover, the distance between the opposing pair of the electrodes 102 and 104 that includes the aperture 172 may be stretched (increased) to compensate for undesired field effects attributable to the presence of the aperture 172.

FIG. 3 is a perspective view of an example of an electrode 300 that may be employed as one or more of the electrodes 102, 104, 106 and 108 of the electrode set 100 illustrated in FIGS. 1 and 2. FIG. 3 illustrates the electrode 300 from the perspective of its inside surface 312, which in practice faces the interior of the electrode set 100. As noted above, the electrode 300 may have a single-section or single-piece construction. In other implementations, as illustrated in FIG. 3, the electrode 300 may be axially segmented into a first end electrode 322, a central or main electrode 324, and a second end electrode 326, with respective axial gaps 302 and 304 defined between the adjacent electrodes 322, 324 and 324, 326. The first end electrode 322 includes a first axial end or end face 332 and an axially opposing second axial end or end face 334, the central electrode 324 includes a first axial end or end face 336 and an axially opposing second axial end or end face 338, and the second end electrode 326 includes a first axial end or end face 342 and an axially opposing second axial end or end face 344. The inside faces of the electrodes 322, 324 and 326 define the gaps 302 and 304. Specifically, the second end face 334 of the first end electrode 322 and the first end face 336 of the central electrode 324 define the first gap 302, and the second end face 338 of the central electrode 324 and the first end face 342 of the second end electrode 326 define the second gap 304.

In the example shown in FIG. 3, the inside surface 312 of the electrode 300 has a generally curved or hyperbolic profile as described above. The apex 372 of the profile may generally correspond to the centerline of the width of the electrode 300. Here, the width of the electrode 300 is generally defined as the transverse dimension between the outer edges of the electrode 300 (the x-direction in FIG. 3). The electrode 300 may have an aperture or slot 376 that is generally collinear with the apex 372 or centerline of the electrode 300. In the illustrated example, the axial length of the aperture 376 is 100% of the axial length of the central electrode section 324 at the apex 372. That is, on the side of the electrode 300 that faces the interior space 202 of the electrode structure 100, the aperture 376 fully extends along the entire length of the central electrode section 324 from the first end face 336 to the second end face 338.

In some implementations, as illustrated in FIG. 3, the end faces 336 and 338 of the central electrode segment 324 are oriented at an angle to the z-axis and to the x-y plane or have a curved profile. The respective orientations of the end faces 336 and 338 are such that the axial length of the inside surface 312 of the central electrode segment 324 is shorter at the apex 372 than at the outer edges. This configuration facilitates providing an aperture 376 whose length is 100% of the length of the inside surface 312 of the central electrode segment 324. The second end face 334 of the first electrode segment 322 and the first end face 342 of the second electrode segment 326 are complementarily angled or curved to maintain geometrical uniformity and minimization of the gaps 302 and 304. The gaps 302 and 304 thus also have an angled or curved orientation. A portion of the first electrode segment 322 and the second electrode segment 326 may also be nested within the central electrode segment 324 as described further below.

The segmentation of the electrode 300 with angles or curves is further illustrated in FIG. 4, which illustrates the electrode 300 from the perspective of its outside surface 402 that is not exposed to the interior space 202 of the electrode structure 100 (FIG. 2). As shown in FIG. 4, the axial length of the aperture 376 on the outside of the electrode 300 may be shorter than the overall length of the central electrode section 324 from this outside perspective. However, the boundaries of the aperture 376 on the outside of the electrode 300 are not as critical as on the inside where the motions of ions are influenced by the applied electrical fields. The axial length of the aperture 376 is still 100% of the length of the central electrode section 324 from the inside perspective, as shown in FIG. 3.

Referring back to FIG. 3, in additional implementations, the inside surface 312 of the electrode 300 includes an axial groove 382 formed along the entire length of the electrode 300, from one end face 332 to the other end face 344 and across each electrode section 322, 324 and 326. Alternatively, the groove 382 may extend along only a portion of the electrode 300. The groove 382 may be located at the apex 372 of the inside surface 312. Accordingly, the portion of the groove 382 that spans the axial length of the central electrode 324, or a shorter sub-portion of this portion, may serve as the aperture 376 or the beginning of the aperture 376 for ejecting ions from the interior space 202 of the electrode structure 100. From the axial groove 382, the depth of the aperture 376 is continued radially through the thickness of the electrode 300 to the outside surface 402 or to a recess 406 of the outside surface 402 if provided (FIG. 4). The groove 382, however, is continued axially across the first end electrode 322 and the second end electrode 326 even though these end electrodes 322 and 326 do not have apertures 376. The portions of the groove 382 spanning the first end electrode section 322 and the second end electrode section 326 extend into the thickness of these electrode sections 322 and 326 to some depth, but not far enough as to constitute through-bores or channels that communicate with the outer surface 402 of the electrode 300 as in the case of the aperture 376. In a sense, the portions of the groove 382 spanning the end electrode sections 322 and 326 may be characterized as emulating the aperture 376 of the central electrode section 324, at least from the perspective of the interior space 202 of the electrode structure 100 and any ions residing in the interior space 202. By this configuration, the surface profile of the inside surface 312 is uniform over at least some uniform section length of the electrode 300 along the z-axis. The uniform section length corresponds to the axial extent of the elongated surface feature—for instance, the 100%-length aperture 376 or the groove 382. A 100%-length aperture 376, an axial groove 382, or an axial groove 382 that effectively extends the axial length of an aperture 376 on the inside surface 312, improves field uniformity along the z-axis as discussed in more detail in U.S. Pat. No. 7,501,623.

The electrodes described in the present disclosure may be fabricated by any suitable technique. In some implementations, various features of the electrodes may be precision-machined by means of wire electrical discharge machining (EDM). For instance, the utilization of EDM may enable electrode surfaces, apertures and grooves to be cut during the same processing run. Moreover, this process may ensure that the geometry of the apertures and grooves and the inside-facing profiles of the electrodes are accurately and precisely positioned relative to one another, which is critical for high-resolution performance.

Figure 5:
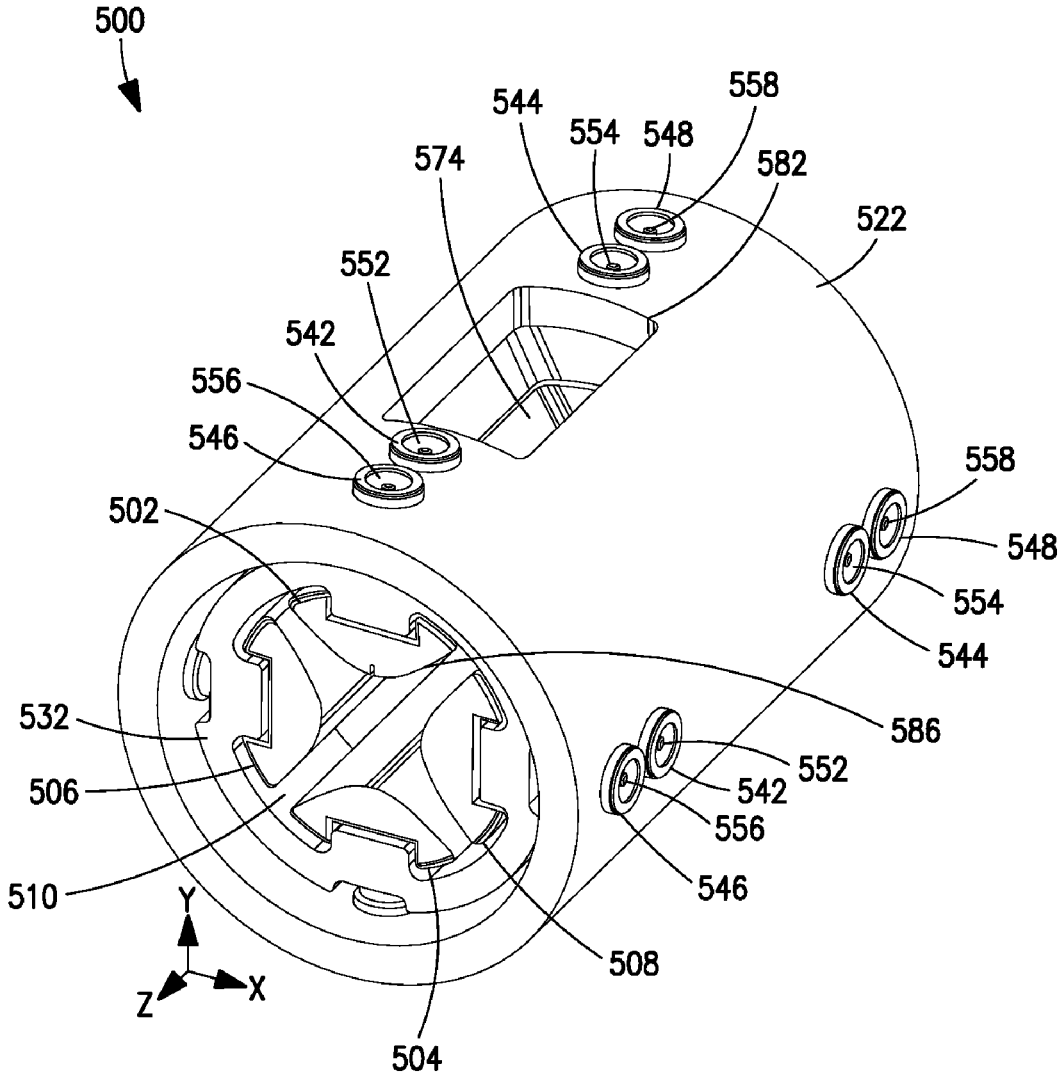
FIG. 5 is a perspective view of an ion processing apparatus provided in accordance with certain implementations described in the present disclosure.

FIG. 5 is a perspective view of an ion processing apparatus 500 for manipulating or processing ions (such as an ion trap, ion storage apparatus, or the like), which may be provided in accordance with implementations described in the present disclosure. The ion processing apparatus 500 may be provided, for example, as part of a suitable mass spectrometry-related instrument or system. The ion processing apparatus 500 includes a plurality of electrodes 502, 504, 506 and 508 that form an electrode set 510 mounted in a suitable outer housing 522. The housing 522 may be shaped as a cylinder or tube for ease of manufacture and alignment with other components. The housing 522, or a lining or layer thereof, may be composed of a suitable electrically conducting material such as, for example, aluminum. By way of example only, the electrode structure 510 illustrated in FIG. 5 has a quadrupolar configuration in which four axially elongated and axially segmented electrodes 502, 504, 506 and 508 are provided as in the case of the electrode structure 100 illustrated in FIG. 1. One or more of the electrodes 502, 504, 506 and 508 may be configured like any one of the electrodes described above and illustrated in FIGS. 1-4, or may have a different configuration.

Figure 6:
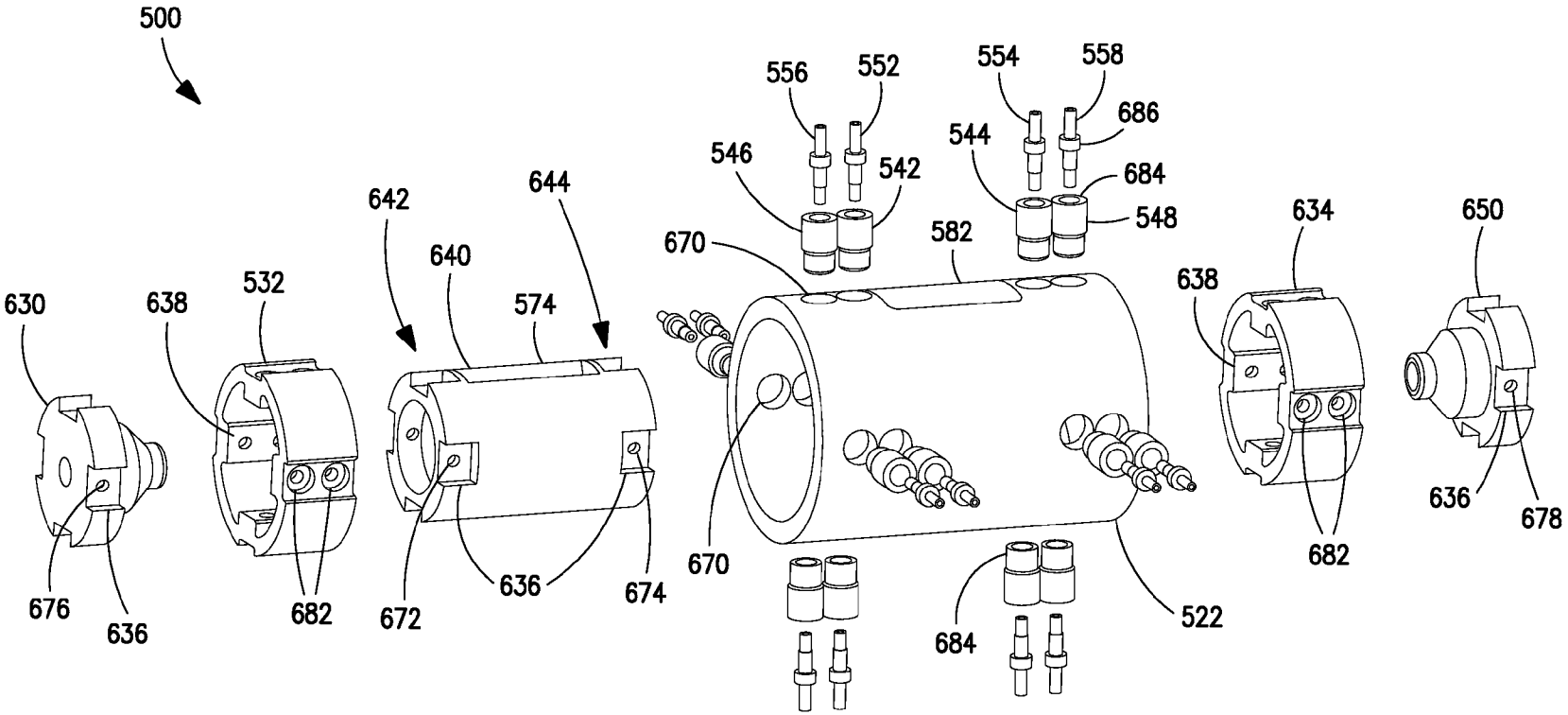
FIG. 6 is a perspective, exploded view of the ion processing apparatus illustrated in FIG. 5, prior to assembly and final shaping of the electrodes.
Figure 7:
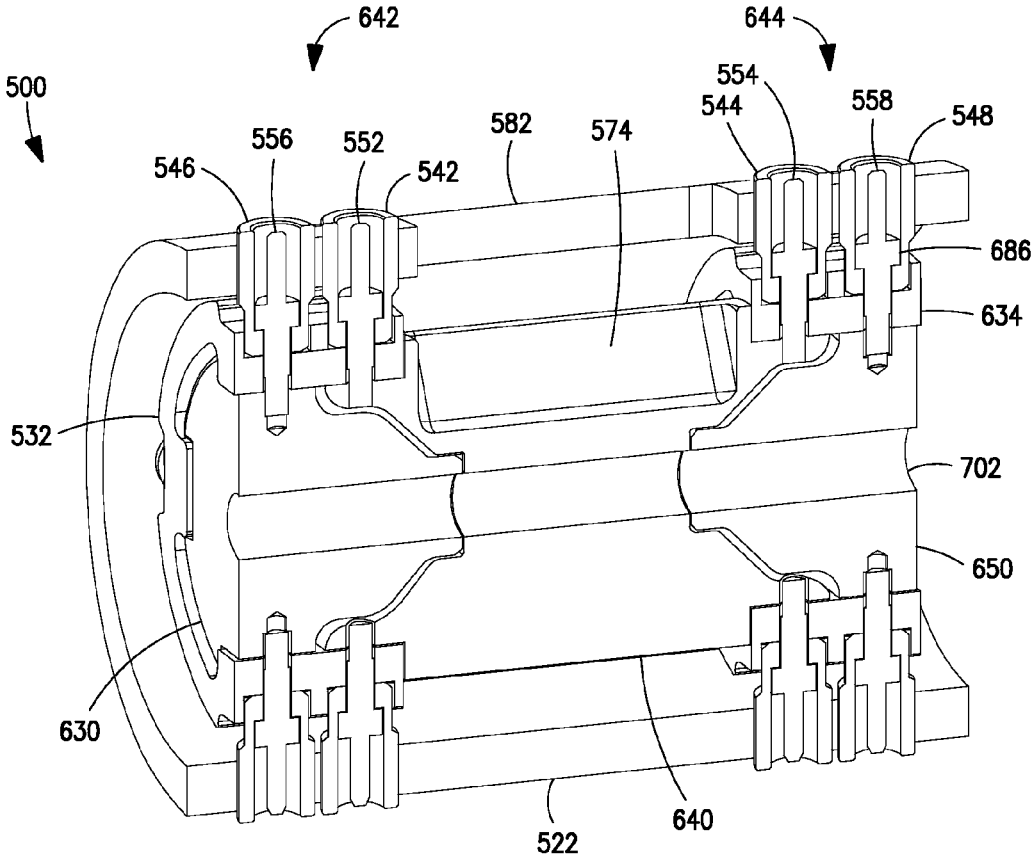
FIG. 7 is a perspective, cross-sectional view taken in the lengthwise (y-z) plane of the assembled ion processing apparatus illustrated in FIG. 5, prior to final shaping of the electrodes.

FIG. 6 is a perspective, exploded view of the ion processing apparatus 500, prior to assembly and final shaping of the electrodes 502, 504, 506, 508. FIG. 7 is a perspective, cross-sectional view of the assembled ion processing apparatus 500 taken in the lengthwise (y-z) plane, prior to final shaping of the electrodes 502, 504, 506, 508. The assembly includes a central electrode blank 640 from which a set of central or main electrodes are formed, a first end electrode blank 630 from which a set of first end electrodes are formed, and a second end electrode blank 650 from which a set of second end electrodes are formed. The electrode blanks 630, 640, 650 may be composed of any electrically conductive material suitable for use in ion processing, one non-limiting example being stainless steel. In the present example, the electrode blanks 630, 640, 650 are assembled with the ion processing apparatus 500 first (FIG. 7) and formed into electrodes subsequently. In the present example, the electrodes are formed by EDM. For this purpose, the electrode blanks 630, 640, 650 may be initially provided with an axial bore 702 (FIG. 7) to accommodate insertion of an EDM wire as appreciated by persons skilled in the art. It will be understood, however, that an EDM technique may be implemented differently and more generally that electrode-forming techniques other than EDM may be implemented. The electrode blanks 630, 640, 650 may be generally cylindrically shaped so that their basic form can be made with economical lathe turning operations, with some secondary milling features as needed. Here, the term "generally" takes into account that the electrode blanks 630, 640, 650 are predominantly cylindrical but may include structural or geometrical features that deviate from perfect cylindrical geometry. The center electrode blank 640 (and the subsequently formed set of main electrodes) includes a first end region 642 and an axially opposing second end region 644. After assembly (FIG. 7), the first end electrode blank 630 is adjacent to the first end region 642 but separated by a gap. The second electrode blank 650 is adjacent to the second end region 644 but likewise separated by a gap. The electrode blanks 630, 640, 650 may be shaped such that at least a portion of the first end electrode blank 630 is nested within the center electrode blank 640 at the first end region 642, and at least a portion of the second end electrode blank 650 is nested within the center electrode blank 640 at the second end region 644. For example, the end electrode blanks 630, 650 may include conical, tapered or scalloped surfaces in addition to cylindrical surfaces, and the axial ends of the center electrode blank 640 may include complementary features. After formation of the electrodes, the gaps and nested features are retained in this example.

To accommodate the radial ejection of ions, one or more of the main electrodes may have an aperture (not shown) with an associated channel depth through the thickness of the electrode, as described above. In the illustrated example, the inner segment of the electrode 502 (FIG. 5) has an aperture that opens into a recess 574. In this example, the recess 574 is initially formed in the center electrode blank 640 (FIG. 7). The housing 522 may include orifices 582 aligned with one or more of the apertures to provide one or more pathways for ejected ions to reach one or more ion detectors (not shown) mounted externally relative to the electrode structure 510. One or more of the electrodes may have a 100%-length or shorter aperture, an elongated surface feature such as an axial groove 586 (FIG. 5), or both an aperture and an axial groove 586, as described above in conjunction with FIGS. 3 and 4. As shown in FIG. 7, the center electrode blank 640 may be shaped so as to provide a 100%-length aperture after the center electrodes are formed as described below.

The ion processing apparatus 500 further includes a first insulator 532 coaxially disposed around the electrode set 510 at the first end region 642 and a second insulator 634 coaxially disposed around the electrode set 510 at the second end region 644. When the electrode set 510 is axially segmented as in the present example, the first insulator 532 is also coaxially disposed around at least a portion of the first end electrodes and the second insulator 634 is also coaxially disposed around at least a portion of the second end electrodes (FIG. 7). The insulators 532, 634 may be composed of a suitable electrically insulating material such as, for example, alumina or other ceramic. As with the housing 522 and electrode blanks 630, 640, 650, the insulators 532, 634 may be generally cylindrical to facilitate fabrication and assembly.

The ion processing apparatus 500 further includes a set of first supports 542, a set of second supports 544, a set of third supports 546, and a set of fourth supports 548. The supports 542, 544, 546, 548 may be composed of a material that is both compliant and electrically insulating, one non-limiting example being polytetrafluoroethylene (PTFE, or Teflon®) or other suitable polymer. The supports 542, 544, 546, 548 may be generally cylindrical to facilitate fabrication and assembly. As described further below, the supports 542, 544, 546, 548 provide a means for fixing the position of the electrode set 510 relative to the insulators 532, 634 and for mechanically isolating the electrode set 510 and the insulators 532, 634 from external forces. Depending on the axial length of an electrode to be supported, one or more supports 542, 544, 546, 548 may be associated with that electrode. In the illustrated quadrupolar arrangement, four first supports 542 are provided to support the respective main electrodes formed from the center electrode blank 640 at the first end regions 642, and four second supports 544 are provided to support the respective main electrodes at the second end regions 644. In an implementation where the electrode set 510 is not segmented, just the first supports 542 and the second supports 544 may be provided. In the segmented implementation specifically illustrated in FIGS. 5-7, four third supports 546 are provided to support the respective first end electrodes formed from the first end electrode blank 630, and four fourth supports 548 are provided to support the respective second end electrodes formed from the second end electrode blank 650. Each support 542, 544, 546, 548 is interposed between, and in contact with, the housing 522 and either the first insulator 532 or the second insulator 634. Each support 542, 544, 546, 548 may be disposed in, and in contact with, a corresponding bore 670 of the housing 522.

While the supports 542, 544, 546, 548 may be characterized as being compliant or deformable, this compliance or deformability is limited to a degree no more than necessary for maintaining the respective positions (e.g., orientation, parallelism, etc.) of the electrodes 502, 504, 506, 508 in response to an external force or shock. Stated in another way, the supports 542, 544, 546, 548 will elastically yield only enough to absorb the force and prevent consequent translation, misalignment or disfigurement of the electrodes 502, 504, 506, 508.

The ion processing apparatus 500 may further include a set of first pins 552, a set of second pins 554, a set of third pins 556, and a set of fourth pins 558. Like the supports 542, 544, 546, 548, the pins 552, 554, 556, 558 may also provide a means for fixing the position of the electrode set 510 relative to the insulators 532, 634. The term "pin" is used herein to encompass any structure suitable for this purpose (e.g., a rod, arm, beam, tube, cylinder, etc.). The pins 552, 554, 556, 558 may also serve as electrical interconnects between the electrodes and various RF and/or DC voltage sources that may be utilized when operating the ion processing apparatus 500 at the voltages and frequencies typical for such operation. As a non-limiting example, the pins 552, 554, 556, 558 may be composed of brass or other electrically conductive material suitable for this purpose. Such pins 552, 554, 556, 558 may be referred to as high-voltage (HV) pins. Generally, each pin 552, 554, 556, 558 contacts a respective support 542, 544, 546, 548 and an electrode. In some implementations, the first pins 552 are inserted through respective first supports 542, through the first insulator 532, and into engagement with the center electrode blank 640. The second pins 554 are inserted through respective second supports 544, through the second insulator 634, and into engagement with the center electrode blank 640. The third pins 556 are inserted through respective third supports 546, through the first insulator 532, and into engagement with the first end electrode blank 630. The fourth pins 558 are inserted through the respective fourth supports 548, through the second insulator 634, and into engagement with the second end electrode blank 650. Hence, after formation of the electrodes, the first pins 552 engage respective main electrodes at the first end regions 642, the second pins 554 engage respective main electrodes at the second end regions 644, the third pins 556 engage respective first end electrodes, and the fourth pins 558 engage respective second end electrodes. The engagement between a pin-electrode pair may be a secure engagement and may be adjustable, such as by interference fit or mating threads.

In the example specifically illustrated in FIGS. 6 and 7, the center electrode blank 640 may include a plurality of first main electrode holes 672 at the first end region 642 and a plurality of second main electrode holes 674 at the second end region 644. At least one first main electrode hole 672 and at least one second main electrode hole 674 may be provided for each main electrode formed from the center electrode blank 640. Likewise, the first end electrode blank 630 may include a plurality of first end electrode holes 676 and the second end electrode blank 650 may include a plurality of second end electrode holes 678. At least one first end electrode hole 676 may be provided for each first end electrode formed from the first end electrode blank 630, and at least one second end electrode hole 678 may be provided for each second end electrode formed from the second end electrode blank 650. The insulators 532, 634 may include bores 682, the number of which may depend on the number of electrodes and whether the electrodes are axially segmented. The supports 542, 544, 546, 548 may likewise include bores 684 (FIG. 7), and the housing 522 may likewise includes bores 670. In implementations where the supports 542, 544, 546, 548 and the pins 552, 554, 556, 558 are cylindrical, the electrode holes 672, 674, insulator bores 682, support bores 684, and housing bores 670 may likewise be cylindrical to facilitate assembly and alignment. In the present example, the insulators 532, 634 are inserted concentrically within the housing 522 relative to the central axis, and the center electrode blank 640, the first end electrode blank 630 and second end electrode blank 650 are assembled concentrically within the insulators 532, 534, in an aligned arrangement. That is, each first main electrode hole 672 is aligned with a corresponding first insulator bore 682, first support bore 684 and housing bore 670 along a respective radial direction (in the x-y plane orthogonal to the central z-axis). Each second main electrode hole 674 is aligned with a corresponding second insulator bore 682, second support bore 684 and housing bore 670 along a respective radial direction. Each first end electrode hole 676 is aligned with a corresponding first insulator bore 682, third support bore 684 and housing bore 670 along a respective radial direction. Each second end electrode hole 678 is aligned with a corresponding second insulator bore 682, fourth support bore 684 and housing bore 670 along a respective radial direction. Once the various components have been assembled in the radially aligned manner, the pins 552, 554, 556, 558 may be inserted along the respective radial directions.

Figure 8:
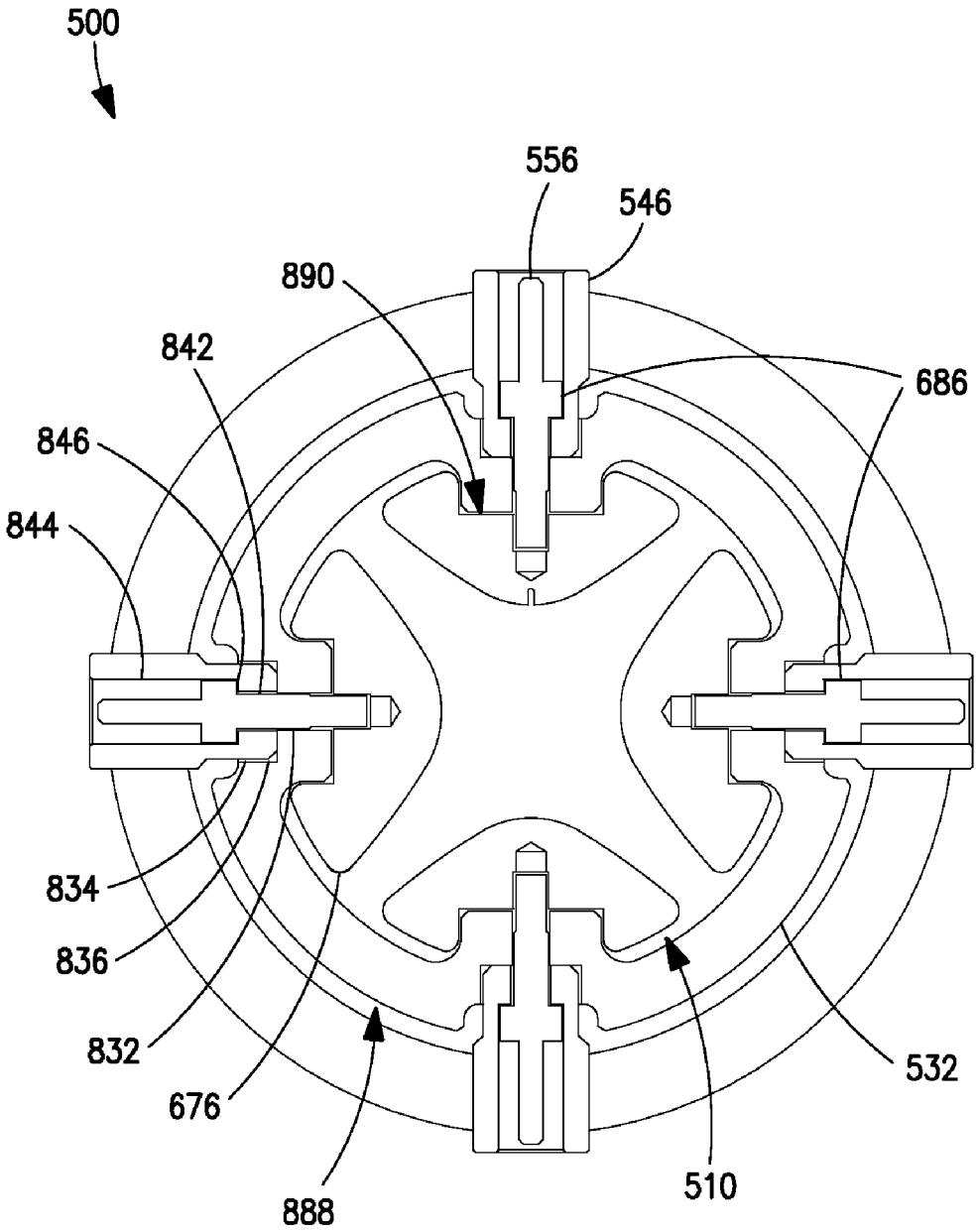
FIG. 8 is a cross-sectional view taken in the x-y plane of the assembled ion processing apparatus illustrated in FIG. 5.

FIG. 8 is a cross-sectional view taken in the x-y plane of the assembled ion processing apparatus 500 illustrated in FIG. 5. The cross-section is taken through the first end electrodes, but may appear the same or similar when taken though the main electrodes or the second end electrodes. In the illustrated example, each insulator bore includes a first section 832 and a second section 834 of different diameter whereby the insulator bore has a stepped-down profile. The diameter of the first section 832 is less than the diameter of the second section 834. The first section 832 transitions to the second section at a shoulder 836. The diameter of the first section 832 is large enough to receive a pin 556, and may be equal or approximately equal to the diameter of the corresponding electrode hole 676. The diameter of the first section 832 is too small, however, to receive the support 546. The outer diameter of the support 546 may be slightly less than the diameter of the second section 834. By this configuration, the support 546 may be seated in the second section 834 of the insulator bore whereby the end of the support 546 contacts the shoulder 836 and the outer wall of the support 546 may or may not contact the inner wall of the second section 834. The foregoing configuration assists in assembling the support 546 in proper alignment with the insulator 532 and in enabling the support 546 to mechanically isolate the insulator 532 and electrode set 510.

Also in the illustrated example, each pin 556 may include a collar 686 or other type of enlarged-diameter feature, which is of greater diameter than the diameter of the portion of the pin 556 inserted toward the electrode. Each support 546 includes a first section 842 and a second section 844 of different diameter whereby the support 546 has a stepped-down profile. The diameter of the first section 842 is less than the diameter of the second section 844. The first section 842 transitions to the second section 844 at a shoulder 846. The diameter of the first section 842 is large enough to receive the pin 556, and may be equal or approximately equal to the diameter of the corresponding first section 832 of the insulator bore and the electrode hole 676. The diameter of the first section 842 is too small, however, to receive the collar 686 of the pin 556. The outer diameter of the collar 686 may be less than the diameter of the second section 844. In some implementations, the outer diameter of the collar 686 is slightly less than the diameter of the second section 844 to assist in properly aligning the pin 556 with the first section 842. By this configuration, the pin 556 may be seated in the second section 844 of the support 546 whereby the end of the collar 686 contacts the shoulder 846. The foregoing configuration assists in assembling together the insulator 532, the support 546 and the pin 556 in proper alignment with each other, and in enabling the support 546 to mechanically isolate the insulator 532 and electrode set 510.

The relative positions of the insulator 532 and a corresponding support 546 and electrode may be fixed by way of the abutment of the collar 686 against the shoulder 846 of the support 546 and the engagement of the pin 556 in the electrode hole 676. In the illustrated example, an end section of the pin 556 is threaded and the electrode hole 676 is complementarily threaded. In this case, the pin 556 is screwed into the electrode hole 676 until the collar 686 abuts the shoulder 846 of the support 546. Any other alternative means for securing or fastening the pin 556 to the electrode may be utilized, one example being by press-fitting the pin 556 into the electrode hole 676. The electrode set 510 and insulators 532, 634 are physically isolated from the housing 522 by respective annular gaps 888. The position of the electrode set 510 and insulators 532, 634 is stabilized via the interface between the supports 542, 544, 546, 548 and the housing 522. By this configuration, any external force imparted to the housing 522 is transferred to the supports 542, 544, 546, 548 only. As noted above, the compliance of the supports 542, 544, 546, 548 is sufficient to prevent such external force from being translated to the electrode set 510 and insulators 532, 634, or to at least significantly reduce the magnitude of any such force that reaches the electrode set 510 and insulators 532, 634.

Also in the illustrated example, each electrode may be separated from a corresponding insulator 532, 634 by a gap or spacing 890 along the radial direction. As described further below, the size of the radial gap 890 (i.e., the distance in the radial direction) is desired to be precisely set and maintained after assembly and during operation of the ion processing apparatus 500. The means by which the pin 556 interfaces with the support 546 and/or the electrode may be utilized for this purpose. As an example, the shoulder 846 of the support 546 may serve as a stop or limit for a pin 556 equipped with a collar 686. Thus, when employing collar-equipped pins 556, the size of the radial gap 890 may be dictated by the radial distance of the shoulder 846 from the outside surface of the electrode surrounding the electrode hole 832—or, equivalently, by the radial length of the portion of the support 546 that defines the first section 842 of the support bore. In another aspect, the size of the radial gap 890 may be dictated by the radial distance of the collar 686 relative to the end of the pin 556 inserted into the electrode, or by the radial distance of the collar 686 from the outside surface of the electrode surrounding the electrode hole 676. Additionally or alternatively, the size of the radial gap 890 may be dictated by the distance through which the pin 556 is permitted to be threaded or otherwise inserted into the electrode hole 676. The limit on pin insertion may be dictated by the position of a collar 686 as described above, or by a stop feature formed in the electrode hole 676, or by a termination of the threads of the electrode hole 676, or a combination of the foregoing. In any of the foregoing cases, the mechanical isolation provided by the compliant supports 542, 544, 546, 548 ensures that the desired gap size is maintained after assembly and during operation of the ion processing apparatus 500.

As further illustrated in FIGS. 6-8, the outside surface of each electrode is modified in comparison to the electrodes illustrated in FIGS. 1-4. Specifically, keyways 636 (depressions, recesses, grooves, or the like) are formed in the outside surface of the main electrode at each end section, and in the outside surface of each end electrode. As shown in FIG. 6, the keyways 636 may be initially provided with the electrode blanks 630, 640, 650. Moreover, the inside surface of each insulator 532, 634 may include splines 638 (e.g., protrusions, keys, lugs, ribs, or the like) protruding inward toward the central axis. The keyways 636 and the splines 638 are circumferentially spaced about the central axis, have respective axial lengths along the central axis, and have complementarily shaped profiles. The keyways 636 and the splines 638 provide a means for aligning the electrode blanks 630, 640, 650 and the insulators 532, 634 during assembly. As evident from FIG. 6, the electrode blanks 630, 640, 650 may be assembled into overlapping relation to the insulators 532, 634 in effect by inserting the splines 638 into corresponding keyways 636. Once this is done, the electrode holes 672, 674, 676, 678 and corresponding insulator bores 682 are aligned in preparation for installing the supports 542, 544, 546, 548 and pins 552, 554, 556, 558. To accommodate the subsequent shaping of the electrodes 502, 504, 506, 508 from the electrode blanks 630, 640, 650, corresponding keyways 636 and splines 638 may be located along the same radii as the electrode holes 672, 674, 676, 678 and corresponding insulator bores 682.

Figure 9:
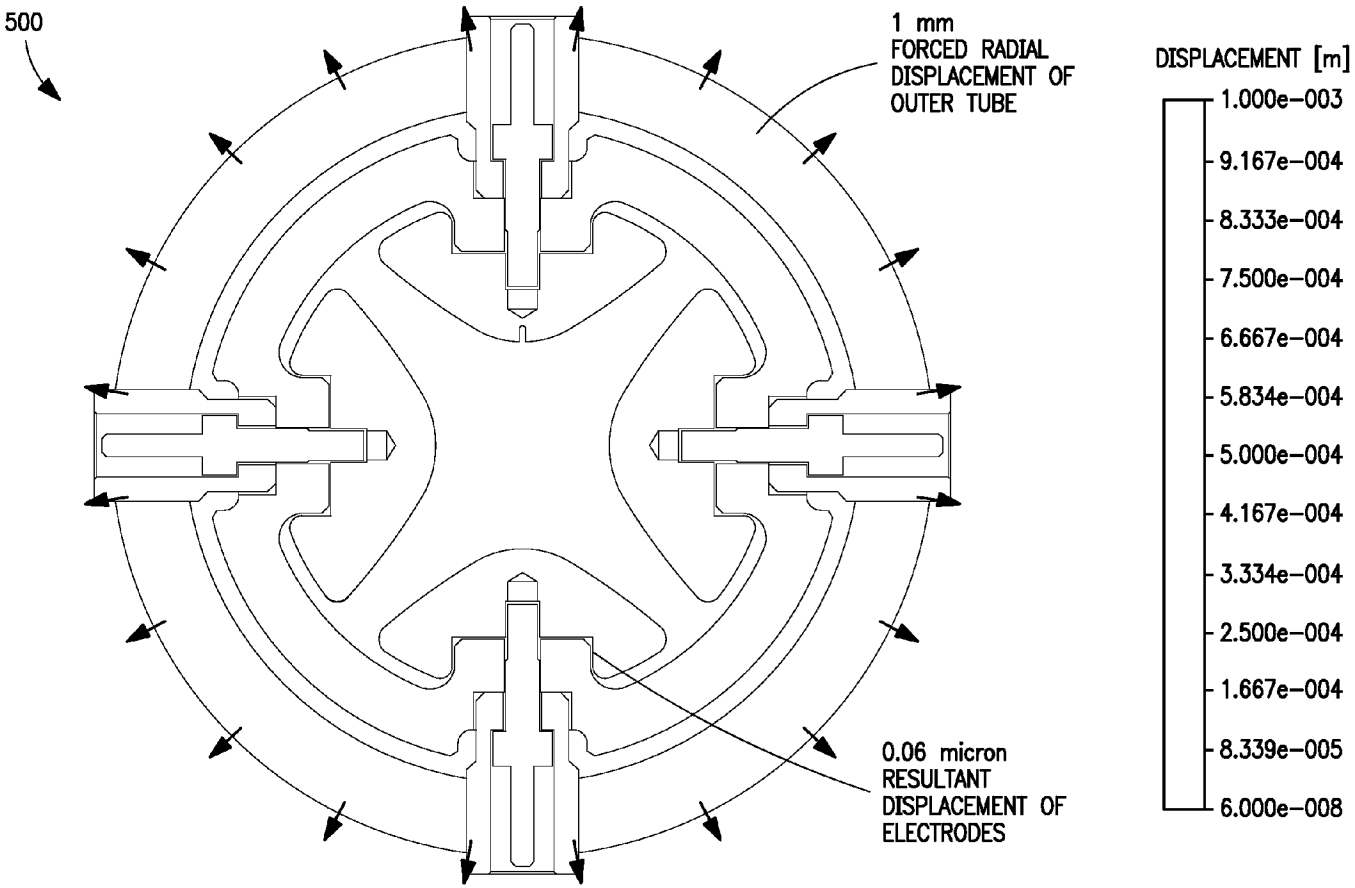
FIG. 9 is an image similar to FIG. 8, resulting from a finite element analysis (FEA) simulation of the ion processing apparatus.

FIG. 9 is an image similar to FIG. 8, resulting from a finite element analysis (FEA) simulation of the ion processing apparatus 500. In this simulation, a radially outward displacement of 1 mm was applied to the housing 522, as depicted by arrows. The applied displacement (albeit extremely large) is representative of a generic external force that might occur on the outside of the ion processing apparatus 500, for example from a mounting strain. The simulation shows the compliant supports 546 deforming. The simulation indicates that the resultant displacement on the electrodes 502, 504, 506, 508 is only 0.06 μm, which is a factor of 17,000× less than the displacement on the housing 522. We have successfully effected this significant mechanical isolation in actual ion trapping devices configured and assembled in accordance with the present disclosure. We have repeatedly swapped these ion traps from instrument to instrument, with little regard to handling of the ion traps, or to fastener torques when mounting the ion traps, or the like. The analytical performance of these ion traps (e.g., mass peak shape, etc.) has been exceptionally consistent throughout this testing. Such mechanical isolation has not been achieved in three-dimensional (3D) ion traps. The latter observation is particularly notable when one considers the commonly expressed belief that a 2D ion trap is more susceptible to mechanical errors than a 3D ion trap due for instance to the extended axial length over which precision is required. In contrast, the 2D ion processing devices disclosed herein are less susceptible to mechanical errors of the type discussed herein as compared with not only conventional 2D ion traps but also 3D ion traps.

An example of a method for assembling the ion processing apparatus 500 and shaping the electrodes 502, 504, 506, 508 will now be described. As an initial matter, it will be noted that the various components of the ion processing apparatus 500 are configured so as to enable the ion processing apparatus 500 to be manufactured in a simple, precise, efficient, and repeatable manner. That is, the ion processing apparatus 500 is characterized by a low part count and utilizing parts that are self-aligning and easily assembled. Referring back to FIG. 6, the ion processing apparatus 500 may be completely assembled from only six unique parts: (1) a center electrode blank 640, (2) two end electrode blanks 630 and 650, (3) two insulators 532 and 634, (4) a housing 522, (5) a set of supports 542, 544, 546 and 548, and (6) a set of pins 552, 554, 556 and 558. As described earlier, each of these components may be generally cylindrical and include self-aligning features. The respective compositions of the components were as follows: stainless steel electrode blanks, alumina insulators, aluminum housing, PTFE supports, and brass pins. The ion processing apparatus 500 is also characterized by facilitating the use of an adhesive to create an adhesive bond in the radial gaps 890 of a predetermined thickness, and facilitating the use of a precise electrode-shaping technique such as, for example, EDM.

Figure 10:
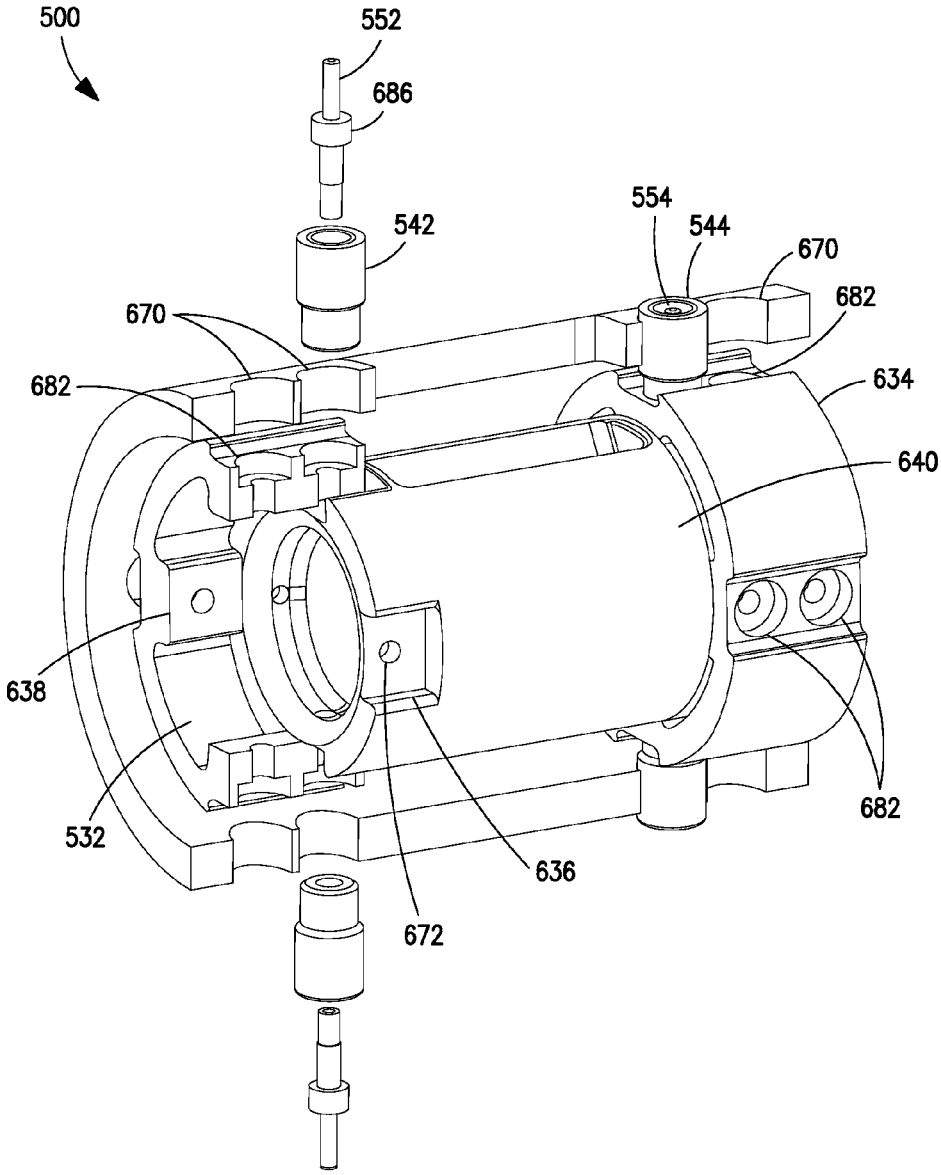
FIG. 10 is a perspective view of a partially assembled ion processing apparatus prior to shaping the electrodes.
Figure 11:
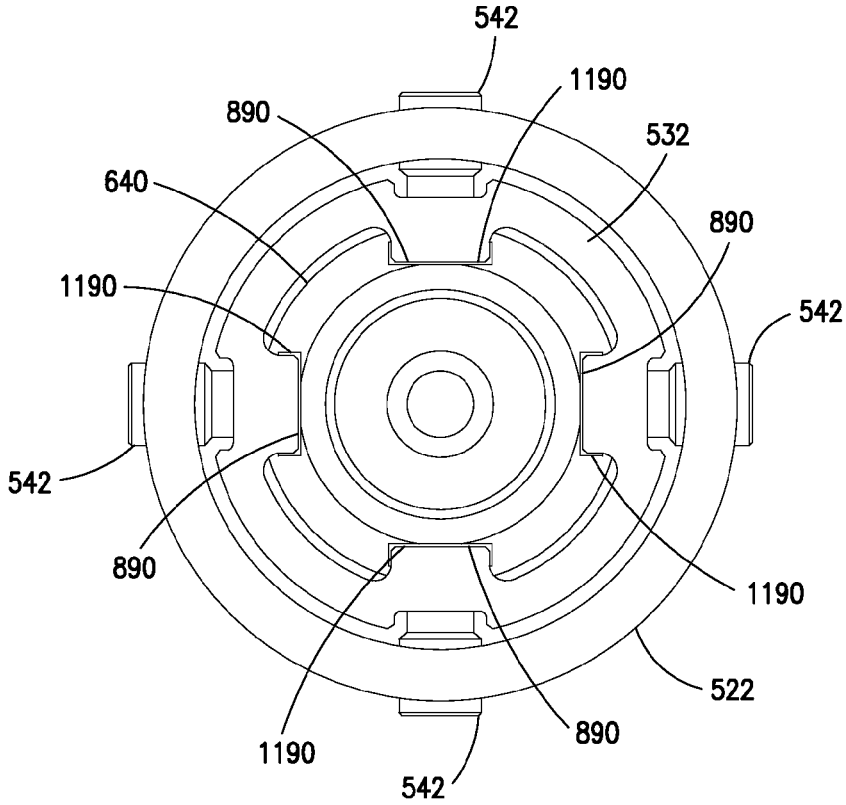
FIG. 11 is an end view of the partially assembled ion processing apparatus illustrated in FIG. 10.
Figure 12:
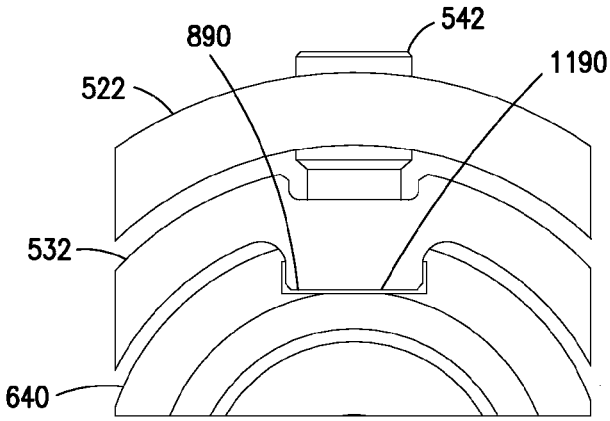
FIG. 12 is a view of a region of the end view of FIG. 11, illustrating a radial gap filled with an adhesive.
Figure 13:
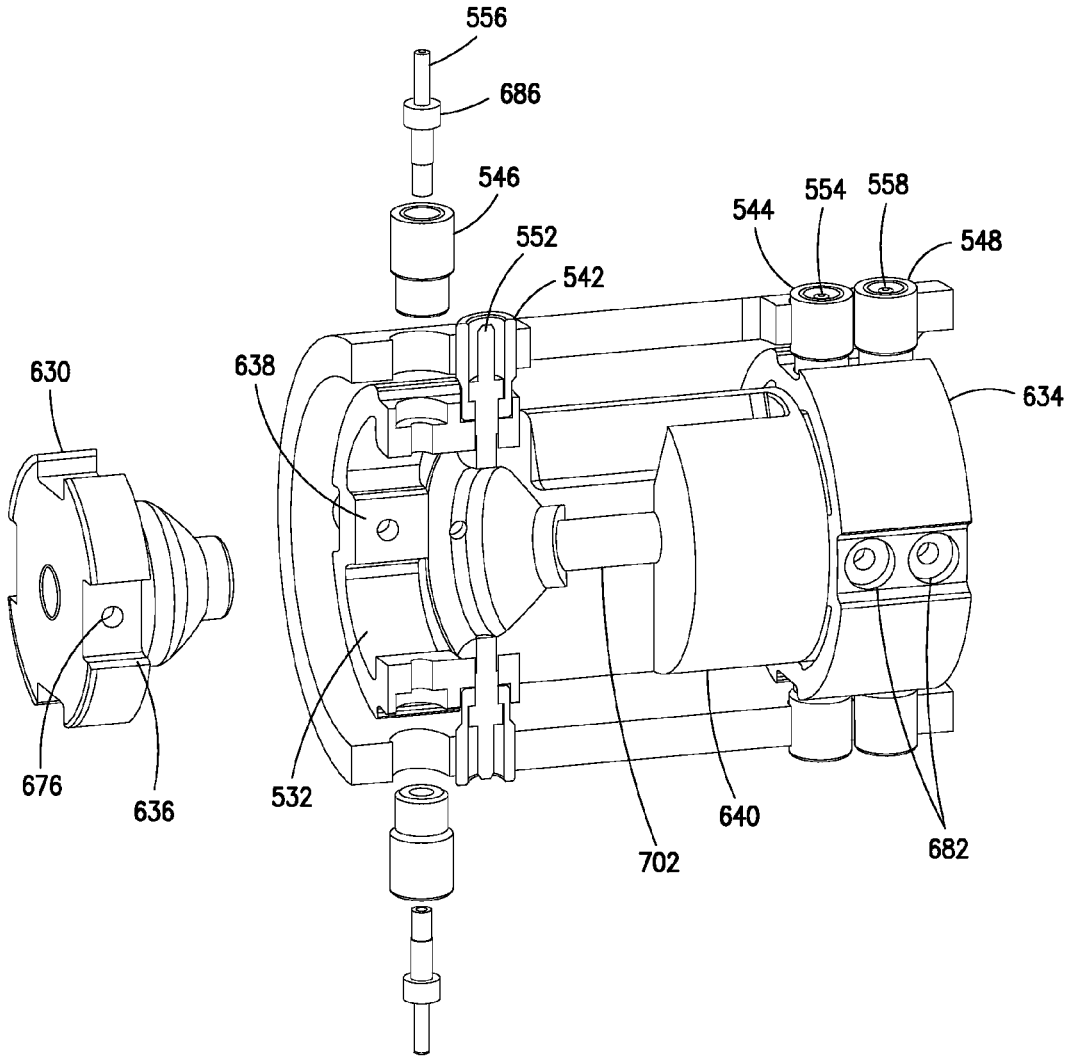
FIG. 13 is another perspective view of the partially assembled ion processing apparatus prior to shaping the electrodes.
Figure 14:
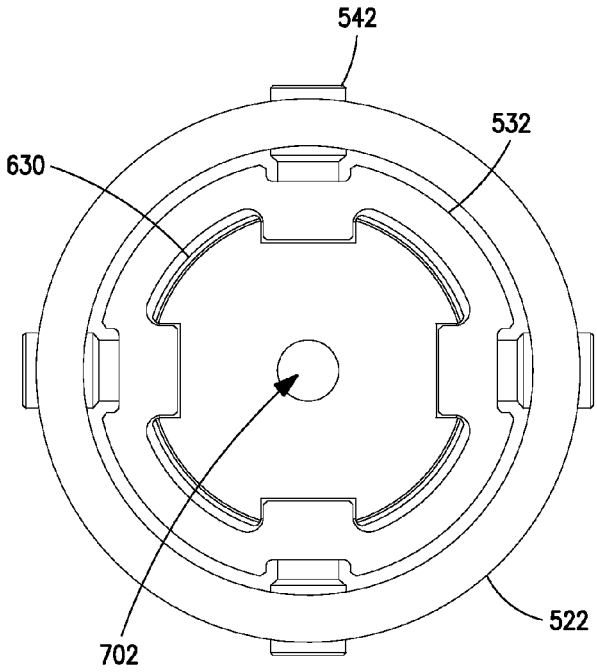
FIG. 14 is an end view of the assembled ion processing apparatus prior to shaping the electrodes.
Figure 15:
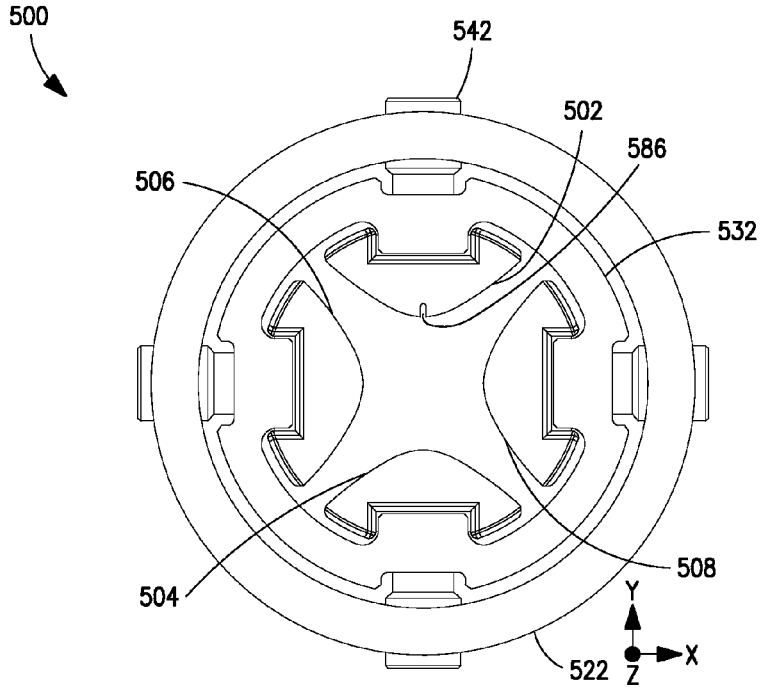
FIG. 15 is an end view of the assembled ion processing apparatus after shaping the electrodes.

The method will be described with reference primarily made to FIGS. 10-15. FIG. 10 is a perspective view of a partially assembled ion processing apparatus 500 prior to shaping the electrodes 502, 504, 506, 508. FIG. 11 is an end view of the partially assembled ion processing apparatus 500 illustrated in FIG. 10. FIG. 12 is a view of a region of the end view of FIG. 11, illustrating the application of an adhesive to a radial gap 890 between the insulator 532 and the center electrode blank 640. FIG. 13 is another perspective view of the partially assembled ion processing apparatus 500 prior to shaping the electrodes 502, 504, 506, 508. FIG. 14 is an end view of the assembled ion processing apparatus 500 prior to electrode shaping. FIG. 15 is an end view of the assembled ion processing apparatus 500 after electrode shaping.

Referring to FIG. 10, as a first step in building the ion processing apparatus 500, the center electrode blank 640 is assembled between the first insulator 532 and the second insulator 634 with proper alignment ensured by corresponding keyways 636 and splines 638. Eight supports 542, 544 are then seated on or in the respective insulators 532, 634 and eight corresponding pins 552, 554 screwed into the tapped electrode holes 672, 674 to fix the relative positions of the center electrode blank 640 and the insulators 532, 634. The supports 542, 544 may be inserted through corresponding housing bores 670 as noted previously.

Referring to FIGS. 11 and 12, the next step is to apply a suitable adhesive 1190 into each radial gap 890 of predetermined thickness so as to completely fill the radial gap 890 with the adhesive 1190. As an example, the adhesive 1190 may be dispensed with a needle to flow the adhesive 1190 via capillary action. The adhesive's viscosity and the gap thickness are chosen such that the adhesive 1190 will completely fill the gap 890 but not leak out over the rest of the assembly. The thickness of the adhesive 1190 is determined by the size of the gap 890, which may be accurately set and maintained as described earlier. The thickness of the adhesive 1190 may be important for various reasons. For instance, a thin adhesive bond is desirable for minimizing electrode displacement that might result from creep of the adhesive 1190 over time. At the same time, however, the adhesive bond should be thick enough so that shear stress resulting from the mismatch in coefficients of thermal expansion as between the electrode and insulator 532 does not become problematic. Taking considerations such as the foregoing into account, optimal adhesive bond thickness may be determined with the use of known engineering calculations.

In one non-limiting example, the adhesive bond thickness was 0.15 mm (0.006 inch). The adhesive was a 2-part epoxy, room-temperature cure, with low out-gassing and high dimensional stability after cure. In this example, referring back to FIGS. 1-3 for illustrative purposes, each electrode 300 had a total axial length of approximately 68 mm and a transverse width of approximately 23 mm. Each first end electrode 322 and second end electrode 326 had a maximum axial length of approximately 18 mm and the central electrode 324 had a maximum axial length of approximately 30 mm. The axial gaps 302 and 304 each had an axial length of approximately 1 mm. The aperture 376 had an axial length of approximately 30 mm and a transverse width of approximately 0.43 mm (7.2% of $r_0$). When the electrode set 100 is assembled (FIGS. 1 and 2), $r_0$=6 mm although the electrode pair that included the aperture 376 was stretched by an additional 1 mm.

Referring to FIG. 13, the next step is to add the end electrode blanks 630 and 650 to the assembly. Each end electrode blank 630 and 650 is assembled concentrically within a corresponding insulator 532 and 634 with proper alignment ensured by corresponding keyways 636 and splines 638. In the illustrated example, a portion of each end electrode blank 630, 650 is nested within a corresponding end region 642, 644 of the center electrode blank 640. The remaining eight supports 546, 548 are then seated and the remaining eight corresponding pins 556, 558 screwed into the respective tapped electrode holes 676, 678 to fix the relative positions of the end electrode blanks 630, 650 and the respective insulators 532, 634. The supports 546, 548 may be inserted through corresponding housing bores 670 as noted previously. Additional adhesive 1190 is applied to the radial gaps 890 to secure the end electrode blanks 630, 650 to the respective insulators 532, 634. At this stage, means may be taken to completely cure the adhesive 1190. The completed assembly prior to electrode shaping is illustrated in cross-section in FIG. 7.

Referring to FIGS. 14 and 15, the fourth and final step is to shape the electrodes 502, 504, 506, 508 as desired (e.g., create hyperbolic surfaces). In the present example, an EDM wire (not shown) is threaded through the central bore 702 extending through the electrode blanks 630, 640, 650 and is aligned with the z-axis. The EDM wire is then charged and moved in the x-y plane relative to the electrode blanks 630, 640, 650 according to programmed instructions. In this manner, all electrodes 502, 504, 506, 508 are created simultaneously. In the present example of an axially segmented, quadrupolar arrangement, the EDM wire creates twelve electrodes 502, 504, 506, 508 of predetermined shape. The EDM wire may also utilized to create the ion ejection aperture by breaking through the center electrode blank 640 into a pre-machined cut-out (recess 574 in FIG. 7). As shown in FIG. 15, the EDM wire may also be utilized to create an axial groove 586 of the type described above, as well as any other desired features. In one non-limiting example, the EDM wire may be a brass wire of 0.25 mm (0.010 inch) diameter. The final assembled ion processing apparatus 500 is shown in FIG. 5.

The subject matter provided in the present disclosure generally relates to electrodes and arrangements of electrodes of the type provided in apparatus employed for manipulating, processing, or controlling ions. The electrode arrangements may be utilized to implement a variety of functions. As non-limiting examples, the electrode arrangements may be utilized as chambers for ionizing neutral molecules; lenses or ion guides for focusing, gating or transporting ions; devices for cooling or thermalizing ions; devices for trapping, storing or ejecting ions; devices for isolating desired ions from undesired ions; mass analyzers or sorters; mass filters; stages for performing tandem or multiple mass spectrometry (MS/MS or $MS^n$); collision cells for fragmenting or dissociating precursor ions; stages for processing ions on either a continuous-beam, sequential-analyzer, pulsed or time-sequenced basis; ion cyclotron cells; and devices for separating ions of different polarities. However, the various applications of the electrodes and electrode arrangements described in the present disclosure are not limited to these types of procedures, apparatus, and systems.

The methods and apparatus described in the present disclosure have been presented primarily in the context of an MS system in which the electrode set is utilized as a multipole ion trap. The methods and apparatus may be applied, for example, to electrode sets and associated ion processing devices of the type described in the following patents, all of which are assigned to the assignee of the present disclosure: U.S. Pat. Nos. 7,034,293; 7,351,965; 7,378,653; 7,405,399; 7,405,400; 7,470,900; and 7,501,623. It will be understood, however, that the present subject matter is not limited to any specific type of MS system. As further examples, the subject matter described in the present disclosure may also find application to ion traps that operate based on Fourier transform ion cyclotron resonance (FT-ICR), which employ a magnetic field to trap ions and an electric field to eject ions from the trap (or ion cyclotron cell). The subject matter may also find application to static electric traps such as described in U.S. Pat. No. 5,886,346. Apparatus and methods for implementing these ion trapping and mass spectrometric techniques are well-known to persons skilled in the art and therefore need not be described in any further detail herein. Moreover, the present subject matter is not limited to MS-based applications.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion processing apparatus, comprising:

a plurality of main electrodes coaxially disposed about a central axis, each main electrode having an axial length extending generally in the direction of the central axis, each main electrode including a first end region and an axially opposing second end region;

a first insulator coaxially disposed about the first end regions;

a second insulator coaxially disposed about the second end regions;

a housing coaxially disposed about the plurality of main electrodes, the first insulator and the second insulator;

a plurality of compliant first supports extending between, and into contact with, the first insulator and the housing; and a plurality of compliant second supports extending between, and into contact with, the second insulator and the housing.

2. The ion processing apparatus of claim 1, further comprising:

a plurality of first pins contacting respective first supports and main electrodes, wherein the first pins fix respective positions of the first supports and the first insulator relative to the main electrodes; and a plurality of second pins contacting respective second supports and main electrodes, wherein the second pins fix respective positions of the second supports and the second insulator relative to the main electrodes.

3. The ion processing apparatus of claim 2, wherein each electrode includes a first electrode hole at the first end region and a second electrode hole at the second end region, each first pin engages a respective first electrode hole, and each second pin engages a respective second electrode hole.

4. The ion processing apparatus of claim 2, wherein:

each main electrode includes a first electrode hole at the first end region and a second electrode hole at the second end region;

the first insulator includes a plurality of first insulator bores aligned with respective first electrode holes;

the second insulator includes a plurality of second insulator bores aligned with respective second electrode holes;

each first support includes a first support bore aligned with a respective first insulator bore and a first electrode hole;

each second support includes a second support bore aligned with a respective second insulator bore and a second electrode hole;

each first pin extends through a respective first support bore and a first insulator bore, and into a first electrode hole; and each second pin extends through a respective second support bore and a second insulator bore, and into a second electrode hole.

5. The ion processing apparatus of claim 1, wherein:

the first supports extend between the first insulator and the outer housing along respective first radial directions relative to the central axis, the second supports extend between the second insulator and the outer housing along respective second radial directions relative to the central axis;

along each first radial direction, the first insulator is separated from a respective main electrode by a first gap; and along each second radial direction, the second insulator is separated from a respective main electrode by a second gap.

6. The ion processing apparatus of claim 5, wherein the first gaps and the second gaps are filled with an adhesive.

7. The ion processing apparatus of claim 5, wherein:

each first gap has a first gap distance along a respective first radial direction, each second gap has a second gap distance along a respective second radial direction, and each main electrode includes a first electrode hole and a second electrode hole, and further comprising:

a plurality of first pins, each first pin contacting a respective first support, extending through a respective first gap, and inserted into a respective first electrode hole by a first insertion distance, wherein the first insertion distance dictates the first gap distance; and a plurality of second pins, each second pin contacting a respective second support, extending through a respective second gap, and inserted into a respective second electrode hole by a second insertion distance, wherein the second insertion distance dictates the second gap distance.

8. The ion processing apparatus of claim 5, wherein:

each first gap has a first gap distance along a respective first radial direction, each second gap has a second gap distance along a respective second radial direction, each first support and each second support include a respective bore and a shoulder protruding into the bore, and each main electrode includes a first electrode hole and a second electrode hole, and further comprising:

a plurality of first pins including respective first collars, each first pin extending through the bore of a respective first support, through a respective first gap, and into engagement with a respective first electrode hole, wherein the first collar abuts the shoulder of the first support, and the first collar is spaced from the respective main electrode by a first collar distance that dictates the first gap distance; and a plurality of second pins including respective second collars, each second pin extending through the bore of a respective second support, through a respective second gap, and into engagement with a respective second electrode hole, wherein the second collar abuts the shoulder of the second support, and the second collar is spaced from the respective main electrode by a second collar distance that dictates the second gap distance.

9. The ion processing apparatus of claim 1, wherein the first insulator and the second insulator are spaced from the housing by respective annular gaps.

10. The ion processing apparatus of claim 1, wherein the first insulator includes a plurality of cylindrical first insulator bores, the second insulator includes a plurality of cylindrical second insulator bores, the first supports are cylindrical and seated into respective first insulator bores, and the second supports are cylindrical and seated into respective second insulator bores.

11. The ion processing apparatus of claim 10, wherein the housing includes a plurality of cylindrical first housing bores and a plurality of cylindrical second housing bores, the first supports are disposed in and contact respective first housing bores, and the second supports are disposed in and contact respective second housing bores.

12. The ion processing apparatus of claim 1, wherein:

the first insulator includes a plurality of first insulator bores, each first insulator bore including a first section of less diameter than the first supports and a second section of greater diameter than the first section, wherein the first supports are seated in the second sections of respective first insulator bores; and the second insulator includes a plurality of second insulator bores, each second insulator bore including a first section of less diameter than the first supports and a second section of greater diameter than the first section, wherein the second supports are seated in the second sections of respective second insulator bores.

13. The ion processing apparatus of claim 12, further comprising:

a plurality of first pins contacting respective first supports and main electrodes and extending through respective first insulator bores; and a plurality of second pins contacting respective second supports and main electrodes and extending through respective second insulator bores.

14. The ion processing apparatus of claim 12, further comprising a plurality of first pins including respective first collars, and a plurality of second pins including respective second collars, wherein:

each first support includes a first support bore, and each first support bore includes a first section of less diameter than the first collars and a second section of greater diameter than the first section;

each second support includes a second support bore, and each second support bore includes a first section of less diameter than the second collars and a second section of greater diameter than the first section;

each first pin extends through a respective first support bore and a first insulator bore and into contact with a respective main electrode, with the first collar disposed in the second section of the first support bore; and each second pin extends through a respective second support bore and a second insulator bore and into contact with a respective main electrode, with the second collar disposed in the second section of the second support bore.

15. The ion processing apparatus of claim 1, wherein each main electrode includes a keyway, the first insulator includes a plurality of first splines disposed in respective keyways, and the second insulator includes a plurality of second splines disposed in respective keyways.

16. The ion processing apparatus of claim 15, wherein each first support is radially aligned relative to the central axis with a first spline and a corresponding keyway, and each second support is radially aligned relative to the central axis with a second spline and a corresponding keyway.

17. The ion processing apparatus of claim 1, further comprising:

a plurality of first end electrodes coaxially disposed about the central axis and axially spaced from the plurality of main electrodes, wherein the first insulator is coaxially disposed about the first end electrodes;

a plurality of second end electrodes coaxially disposed about the central axis and axially spaced from the plurality of main electrodes, wherein the second insulator is coaxially disposed about the second end electrodes;

a plurality of compliant third supports; and a plurality of compliant fourth supports, wherein:

the first insulator is interposed between each main electrode and each first support, and between each main electrode and each third support; and the second insulator is interposed between each main electrode and each second support, and between each main electrode and each fourth support.

18. The ion processing apparatus of claim 17, further comprising:

a plurality of first pins contacting respective first supports and main electrodes, wherein the first pins fix respective positions of the first supports and the first insulator relative to the main electrodes;

a plurality of second pins contacting respective second supports and main electrodes, wherein the second pins fix respective positions of the second supports and the second insulator relative to the main electrodes;

a plurality of third pins contacting respective third supports and first end electrodes, wherein the third pins fix respective positions of the third supports and the first insulator relative to the first end electrodes; and a plurality of fourth pins contacting respective fourth supports and second end electrodes, wherein the fourth pins fix respective positions of the fourth supports and the second insulator relative to the second end electrodes.

19. A method for constructing an ion processing apparatus, the method comprising:

inserting an electrode blank between a first insulator and a second insulator, the electrode blank having an axial length along a central axis, and the electrode blank including a first end region and an axially opposing second end region, wherein the first insulator is coaxially disposed about the first end region and the second insulator is coaxially disposed about the second end region;

inserting the electrode blank, the first insulator and the second insulator into a housing;

placing a plurality of compliant first supports between, and into contact with, the first insulator and the housing;

placing a plurality of compliant second supports between, and into contact with, the second insulator and the housing; and forming the electrode blank into a plurality of electrodes, wherein each electrode is supported by a first support at the first insulator and by a second support at the second insulator.

20. The method of claim 19, further comprising fixing respective positions of the first support and the first insulator relative to the electrode blank by placing a plurality of first pins into contact with respective first supports and the electrode blank, and fixing respective positions of the second support and the second insulator relative to the electrode blank by placing a plurality of second pins into contact with respective second supports and the electrode blank.

* * * * *